US006810681B2

(12) United States Patent
Erisgen et al.

(10) Patent No.: US 6,810,681 B2
(45) Date of Patent: Nov. 2, 2004

(54) METHOD OF DRAINING AND RECHARGING HERMETIC COMPRESSOR OIL

(75) Inventors: Sukru Erisgen, Tecumseh, MI (US); James D. Rutz, Adrian, MI (US)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 10/457,191

(22) Filed: Jun. 9, 2003

(65) Prior Publication Data

US 2003/0230090 A1 Dec. 18, 2003

Related U.S. Application Data

(60) Provisional application No. 60/387,812, filed on Jun. 11, 2002.

(51) Int. Cl.[7] ..... F25B 45/00
(52) U.S. Cl. ..... 62/77; 62/84
(58) Field of Search ..... 62/77, 84, 292, 62/298

(56) References Cited

U.S. PATENT DOCUMENTS

| | | | | |
|---|---|---|---|---|
| 3,225,554 A | | 12/1965 | Alexander | 62/77 |
| 3,443,392 A | | 5/1969 | Alexander | 62/77 |
| 3,564,863 A | | 2/1971 | Sasselli | 62/84 |
| 4,570,458 A | | 2/1986 | Avery, Jr. | 62/503 |
| 4,698,983 A | | 10/1987 | Hechavarria | 62/292 |
| 5,086,630 A | * | 2/1992 | Van Steenburgh, Jr. | 62/475 |
| 5,167,126 A | * | 12/1992 | Cartwright | 62/129 |
| 5,184,944 A | | 2/1993 | Scarfone | 417/410 |
| 5,222,369 A | * | 6/1993 | Hancock et al. | 62/149 |
| 5,247,802 A | * | 9/1993 | Maniez et al. | 62/77 |
| 5,373,914 A | | 12/1994 | Maher | 184/1.5 |
| 5,437,162 A | | 8/1995 | Eden | 62/125 |
| 5,522,475 A | | 6/1996 | Thompson | 184/1.5 |
| 5,560,215 A | * | 10/1996 | Talarico | 62/149 |
| 5,603,223 A | * | 2/1997 | Murray et al. | 62/84 |
| 5,638,690 A | | 6/1997 | Berglof | 62/84 |
| 5,678,412 A | | 10/1997 | Byrne et al. | 62/84 |
| 5,685,161 A | * | 11/1997 | Peckjian et al. | 62/149 |
| 6,092,390 A | | 7/2000 | Griffith, Jr. | 62/468 |

FOREIGN PATENT DOCUMENTS

JP 409310928 A * 12/1997

* cited by examiner

*Primary Examiner*—William Doerrler
*Assistant Examiner*—Mohammad M. Ali
(74) *Attorney, Agent, or Firm*—Baker & Daniels

(57) ABSTRACT

A method of draining and recharging a hermetic compressor with oil using a drainage assembly mounted in the compressor housing. The assembly includes a tube having a valve mounted at one end thereof with the second end of the tube located in the oil sump of the housing. To drain the compressor oil, refrigerant flowing through the discharge and suction lines is shut off. Refrigerant is purged from the housing to create a vacuum therein and the housing is charged with a gas such as dry air or nitrogen. As the compressor housing is charged with gas, the pressure inside the housing increases, forcing the oil through the drainage assembly and out of the compressor. To recharge the compressor with oil, the gases are purged creating a vacuum in the housing. A predetermined amount of oil is drawn into the housing through a service hose. The compressor is purged and recharged with refrigerant.

3 Claims, 2 Drawing Sheets

METHOD OF DRAINING AND RECHARGING HERMETIC COMPRESSOR OIL

CROSS REFERENCE TO RELATED APPLICATIONS

This application claims priority under 35 U.S.C. 119(e) of U.S. provisional patent application serial No. 60/387,812 filed on Jun. 11, 2002 entitled METHOD OF DRAINING AND RECHARGING HERMETIC COMPRESSOR the disclosure of which is hereby incorporated by reference.

BACKGROUND OF THE INVENTION

The present invention relates to hermetic compressors, and more particularly to draining compressor oil from a hermetic compressor and recharging a hermetic compressor with oil.

In general, lubricating fluid such as oil is removed from a hermetic compressor for any number of reasons. One such reason may be that a sample of the oil is needed for testing to analyze its properties such as viscosity, for example. Additionally, it may be desired to determine the amount of oil located in the compressor housing in comparison to the amount of oil the compressor had been initially charged with, thus determining if there had been any oil loss during compressor operation. By determining the amount of oil located in the compressor housing, one can also ensure that a sufficient amount of oil is available to the compressor components during compressor operation. Further, spent oil may be removed from the compressor housing and replaced with fresh, clean, or a different type of oil.

Conventionally, to drain oil from a hermetic compressor, the compressor must be disconnected and removed from its assembly with a refrigeration system. The suction, discharge, and electrical connections are disconnected and the compressor is removed from the refrigeration system. The oil in the compressor housing is poured from the compressor housing through a drain/fill opening in the housing into a suitable container. After being drained, the compressor may be recharged with oil through the drain/fill opening and reassembled to the refrigeration system.

A problem with this method of draining oil from a hermetic compressor is that the removal of the compressor from its assembly in the refrigeration system is time consuming, labor intensive, and expensive. The removal of the compressor requires stopping refrigerant flow through the suction and discharge lines and then disconnecting the suction line, discharge line, and electrical connections. An additional problem is that refrigerant may leak from the suction and discharge lines as well as from the compressor after being disconnected.

It is desired to provide a method and apparatus for draining oil from and recharging oil into a hermetically sealed compressor without having to remove the compressor from its system.

SUMMARY OF THE INVENTION

The present invention relates to a hermetically sealed compressor having a drainage or dip tube assembly mounted in the housing thereof to facilitate draining and recharging of compressor oil. The dip tube assembly includes an elongated tube located primarily within the compressor housing having a valve, such as a Schrader valve, secured to an end thereof. The valve is mounted in the compressor housing by welding, brazing, or the like to secure the dip tube assembly therein.

The tube is bent, being downwardly inclined so that the tube approaches the bottom of the compressor housing. The internal end of the tube is flattened so that the area of the opening in the end of the tube is as close to the housing bottom as possible to facilitate draining of nearly all of the compressor oil stored in the compressor housing.

The method of draining the compressor oil from the hermetically sealed compressor includes first shutting off flow to the discharge and suction lines of the compressor. The refrigerant is purged from the housing to create a vacuum therein. The housing is then charged through a service port with a gas such as dry air, nitrogen, or the like. As gas is charged into the compressor housing, the pressure inside the compressor housing increases and acts on the oil located in the sump. The pressure forces the oil into the dip tube, through the valve, and through a service hose into a container. The amount of gas charged into the compressor housing controls the pressure therein as well as the amount and speed of the oil being purged.

In order to recharge the compressor with oil, the gases are purged from the compressor housing which again creates a vacuum therein. A service hose is connected to the service port and a predetermined amount of oil is drawn through the hose into the compressor housing. The compressor is purged for a third time, creating a vacuum in the housing, and the compressor is charged with refrigerant.

Certain embodiments of the present invention provide a drainage assembly for a hermetically sealed compressor having a housing. The drainage assembly includes a drainage tube having a first and second end with a valve mounted to the first end thereof. The valve is mounted in the compressor housing with the second end of the drainage tube extending into the compressor housing. Lubricating oil is removed from the compressor housing through the drainage tube and the valve.

Certain embodiments of the present invention also provide a drainage assembly for a hermetically seal compressor having a housing with a bottom. The drainage assembly includes a drainage tube having a first and second end, the first end having a valve mounted thereon. The valve is mounted in the compressor housing. The drainage tube is downwardly inclined with the second, flattened end of the tube approaching the bottom of the compressor housing. Lubricating oil is removed from the compressor housing through the drainage tube and the valve.

Certain embodiments of the present invention also provide a method of draining oil from a hermetic compressor having a housing with a sump formed therein including shutting off refrigerant flow to a suction tube and a discharge tube mounted in the compressor housing; purging refrigerant from within the compressor housing creating a vacuum therein; charging the compressor housing with a gas through a service port mounted in the compressor housing; and forcing oil in the compressor housing to pass through a drainage assembly extending into the compressor sump and out of the compressor housing.

One advantage of the present invention is that the oil located in a hermetic compressor may be drained and recharged without having to remove the compressor from its assembly with other components of a refrigeration system.

A further advantage of the present invention is that the method used to drain and recharge hermetic compressor oil is efficient and inexpensive.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
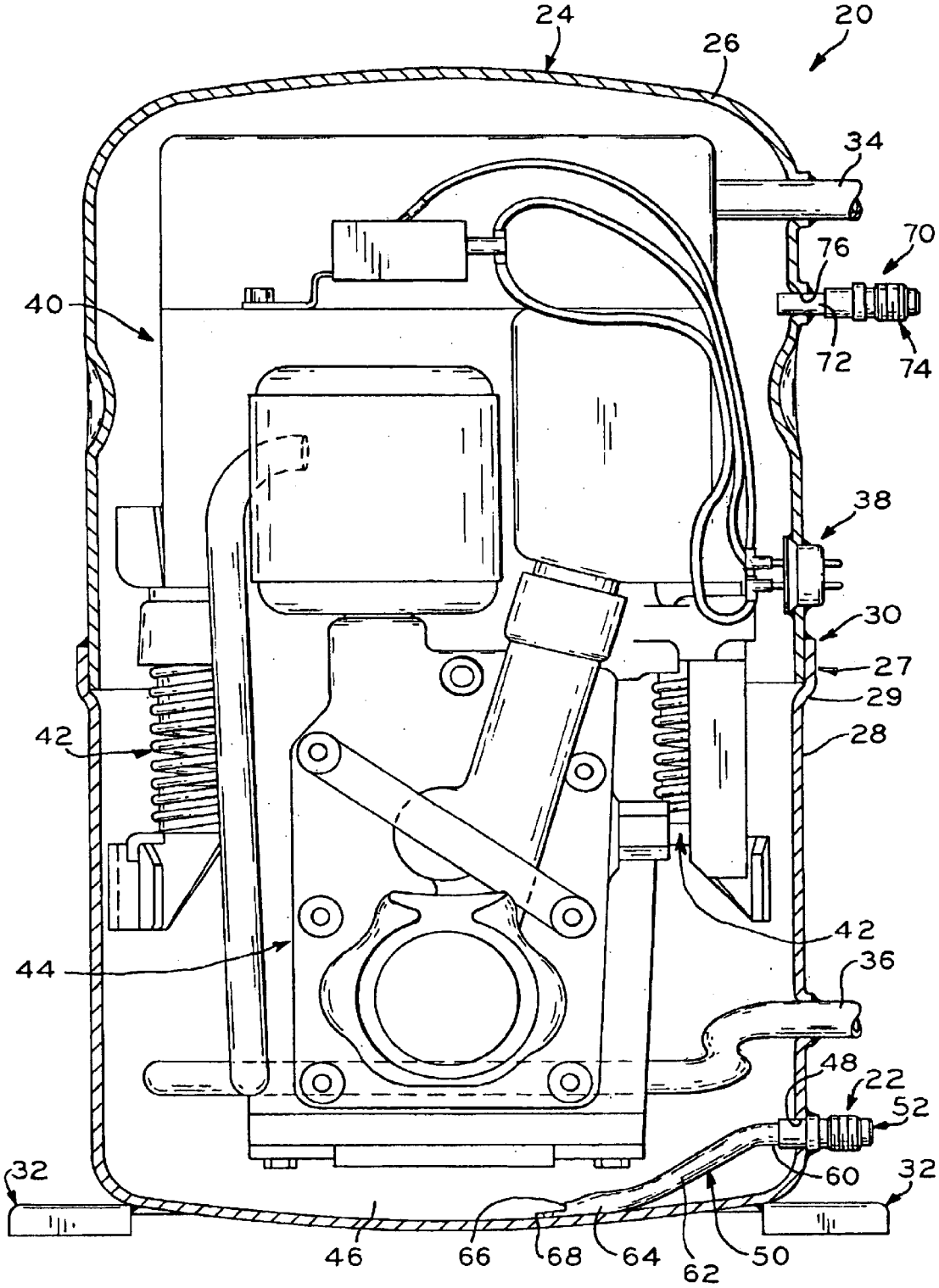
FIG. 1 is a sectional view of a compressor in accordance with the present invention.

Corresponding reference characters indicate corresponding parts throughout the several views. Although the drawings represent an embodiment of the present invention, the drawings are not necessarily to scale and certain features may be exaggerated in order to better illustrate and explain the present invention.

DETAILED DESCRIPTION OF THE INVENTION

Figure 6:
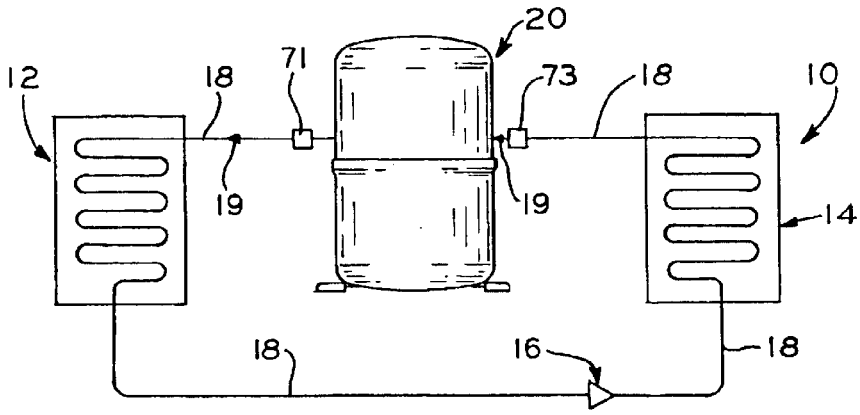
FIG. 6 is schematic view of a refrigeration system in accordance with the present invention.

Referring to FIG. 6, hermetic compressor 20 is part of schematically illustrated refrigeration system 10. As is typical, refrigeration system 10 includes condenser 12, evaporator 14, expansion valve 16, and compressor 20 in fluid communication via conduits 18. Refrigerant fluid flows through refrigeration system 10 in the direction of arrows 19.

Referring to FIG. 1, compressor 20 includes housing 24 which may be formed from two or more pieces. As shown, housing 24 includes upper housing portion 26 and lower housing portion 28 which mate at joint 30. One of upper housing portion 26 and lower housing portion 28 is provided with flanged portion 27 which is sized to receive the other of upper housing portion 26 and lower housing portion 28. Located between flanged portion 27 and the wall of housing portion 28 is transition portion 29. When housing portions 26 and 28 are mated with one another, the housing portion being received in flanged portion 27 in inserted until contacting transition portion 29. Housing portions 26 and 28 are then hermetically sealed at joint 30 by welding, brazing, or the like.

Compressor 20 is provided with mounting feet 32 secured to the closed end of lower housing portion 28. Mounting feet 32 are provided to support compressor 20 in a substantially vertical orientation, however, compressor 20 may be alternatively positioned in a substantially horizontal orientation. Mounting feet 32 may be formed having any suitable shape and size to support compressor 20.

Extending through and mounted in the wall of compressor housing 24 of compressor 20 are suction tube 34, discharge tube 36, dip tube assembly 22, terminal assembly 38, and service port 70. Compressor motor 40 is mounted within compressor housing 24 and is electrically connected to an external power source (not shown) via terminal assembly 38. Compressor motor 40 is mounted within housing 24 by spring mounts 42 which are each fixedly secured at one end to the inner surface of lower housing 28. The opposite end of each spring mount 42 is secured to motor 40 to support motor 40 within housing 24. Mounted directly below motor 40 is reciprocating piston compression mechanism 44 being operably coupled thereto by a driveshaft (not shown) in a conventional manner. Compressor 20 may be provided with any suitable type of compression mechanism including reciprocating piston, as shown, or scroll or rotary, for example.

Refrigerant from evaporator 14 of refrigeration system 10 (FIG. 6) which is at substantially suction pressure, is drawn into the housing of compressor 20 through suction tube 34 (FIG. 1). During compressor operation, this refrigerant is drawn into compression mechanism 44 and is compressed to a higher, substantially discharge pressure, and is exhausted from compressor 20 through discharge tube 36 and again passed through refrigeration system 10.

Referring to FIG. 1, compresser 20 is provided with drainage or dip tube assembly 22 which is used to drain and recharge the hermetic compressor oil located therein. Dip tube assembly 22 is located in lower housing 28, being mounted in aperture 48 formed therein by welding, brazing, or the like. Formed beneath compression mechanism 44, in lower housing 28, is oil sump 46 into which dip tube assembly 22 extends.

Figure 2:
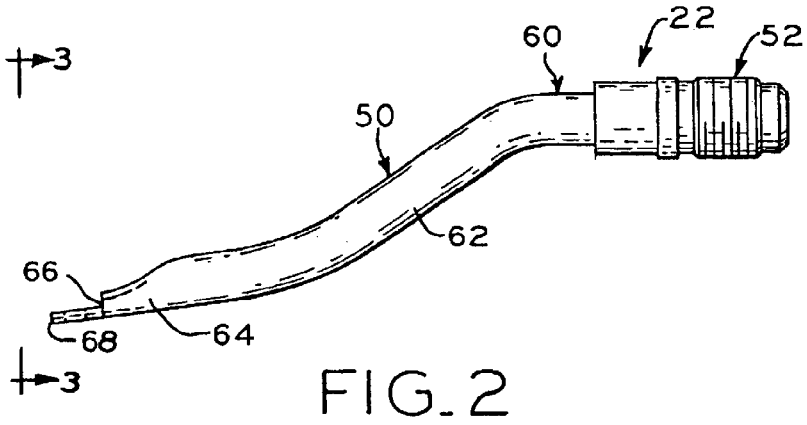
FIG. 2 is a side view of a dip tube assembly of the present invention.
Figure 3:
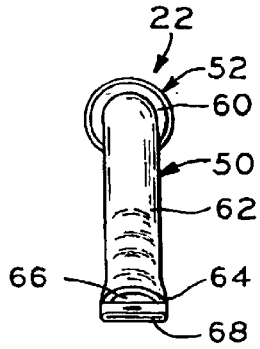
FIG. 3 is an end view of the dip tube assembly of FIG. 2.

Referring to FIGS. 1 through 3, dip tube assembly 22 includes tube 50 having valve 52 secured to end 54 (FIG. 4) thereof. Tube 50 is interference fitted into bore 56 (FIG. 4) extending through valve 52 to interconnect tube 50 and valve 52. The connection between tube 50 and valve 52 may additionally be welded, brazed, or the like to ensure sealing therebetween.

Figure 4:
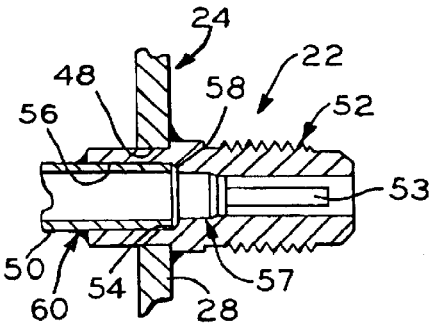
FIG. 4 is a fragmentary, sectional view of a service valve of the present invention mounted in the compressor housing.
Figure 5:
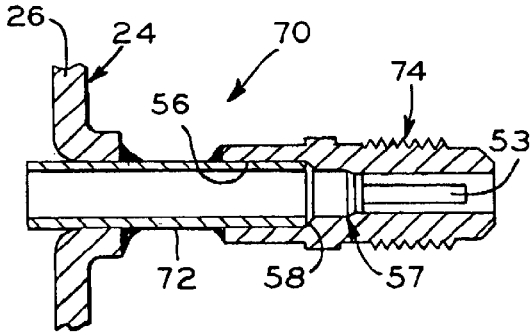
FIG. 5 is a fragmentary, sectional view of the dip tube assembly of the present invention mounted in the compressor housing.

Valve 52 may be any suitable type of valve including a conventional Schrader valve as shown in FIGS. 4 and 5. The Schrader type valve has spring-tensioned pin 53 located centrally therein. Bore 56 is stepped at 58 to provide a seat for valve portion 57 of spring-tensioned pin 53 to seal against to prevent fluid leakage when pin 53 is not depressed. When pin 53 is depressed, valve portion 57 moves away from its seat to allow fluid to pass through bore 56. Valve 52 is constructed by any suitable method, from any suitable material including metal such as steel so that it may be secured to the outer surface of lower housing portion 28 by welding, brazing, or the like.

Referring to FIGS. 2 and 3, elongated tube 50 is substantially cylindrical for most of the length of the tube. Tube 50 may be constructed from any suitable material including metal or plastic and may be formed using a method such as casting, molding, or the like. Tube 50 has first portion 60 at end 54 which is substantially linear to be received in bore 56 of valve 52. Extending from first portion 60 is downwardly inclined portion 62 with third, substantially linear portion 64 extending therefrom. With dip tube assembly 22 mounted above the bottom of lower housing 28 (FIG. 1), inclined portion 62 of tube 50 is necessary to direct opening 66 at end 68 of tube 50 toward the bottom of lower housing 28. This allows end 68 of tube 50 to be located as close as possible to or in contact with the bottom of oil sump 46.

As shown in FIGS. 2 and 3, end 68 of tube 50 is flattened to create substantially oval shaped opening 66. By flattening the end of tube 50, the area of opening 66 moves closer to the bottom of the oil sump 46 such that nearly all of the oil contained therein may be removed. It is possible to remove approximately 99 percent of the oil contained in housing 24.

Dip tube assembly 22 may be used to drain compressor oil from hermetic compressor 20 as well as recharge hermetic compressor 20 with oil. Compressor 20 may also be recharged with oil through service port 70 (FIGS. 1 and 5) as discussed further hereinbelow. In order to drain oil from compressor 20, refrigerant flow to suction tube 34 and discharge tube 36 is shut off by actuating service valves 71 and 73 (FIG. 6) located in each of the suction and discharge tubes, externally of compressor housing 24. The service valves may be of any suitable type known in the art which can fluidly isolate the compressor from the rest of the refrigeration system without disconnecting the fluid lines. The refrigerant within compressor 20 is purged through service port 70 (FIGS. 1 and 5) by a conventional vacuum pump which creates a vacuum in the housing. The housing is then charged through service port 70 with a gas such as dry air, nitrogen, or any other suitable gases.

Referring to FIG. 5, service port 70 includes tube 72 which is mounted in aperture 76 in upper portion 26 of housing 24 by any suitable method including welding, brazing, or the like. Valve 74 is secured to the external end of tube 72 by an interference fit as well as welding, brazing, or the like with valve 74 being any suitable type of valve including a service valve actuated by an operator, or a Schrader valve. Alternatively, valve 74 may be mounted directly in compressor housing 24. Service port 70 may be located at any position in compressor housing 24 above the level of oil in sump 46.

As the gas is supplied to compressor housing 20, a pressure is created within the housing which acts on the oil in oil sump 46. As the pressure increases, the force acting on oil in sump 46 increases, causing oil to move through opening 66 into tube 50. The amount of pressure within housing 24 controls the amount and speed of oil purged from housing 24. As the pressure is increased further, the oil is drained from oil sump 46 through tube 50 and valve 52. A service tube or hose may be attached to valve 52 to direct the oil into a storage or waste container. Compressor housing 24 is charged with the gas through service port 70 until the desired amount of oil is removed from oil sump 46.

When recharging compressor 20 with oil, the gases in compressor housing 24 which forced the oil out of housing 24 are purged through dip tube assembly 22 or service port 70 using a vacuum pump, thus creating a vacuum in compressor housing 24. A service hose is connected at one end to valve 52 of dip tube assembly 22 or valve 74 of service port 70 with the second end extending into a container of oil. The vacuum within compressor housing 24 draws oil from the container, through the service hose and dip tube assembly 22 or service port 70 into oil sump 46. A predetermined amount of oil is suctioned into the compressor providing sufficient oil within sump 46 for operation of compressor 20. Compressor 20 is purged for a second time and recharged with refrigerant.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A method of draining oil from a hermetic compressor having a housing with a sump formed therein, comprising;

shutting off refrigerant flow to a suction tube and a discharge tube mounted in the compressor housing;

purging refrigerant from within the compressor housing creating a vacuum therein;

charging the compressor housing with a gas through a service port mounted in the compressor housing; and forcing oil in the compressor housing to pass through a drainage assembly extending into the compressor sump and out of the compressor housing.

2. The method of claim 1, further comprising increasing pressure within the compressor housing as the housing is charged with the gas.

3. The method of claim 1, further comprising forcing oil through a drainage tube of the drainage assembly and a valve secured to one end of the drainage tube and mounted in the compressor housing.

* * * * *